United States Patent [19]

Paul et al.

[11] Patent Number: 4,620,074

[45] Date of Patent: Oct. 28, 1986

[54] CONTACT ARRANGEMENT FOR VACUUM SWITCHES

[75] Inventors: Bernt-Joachim Paul, Erlangen; Roman Renz, Berlin, both of Fed. Rep. of Germany

[73] Assignee: Siemens Aktiengesellschaft, Munich, Fed. Rep. of Germany

[21] Appl. No.: 704,428

[22] Filed: Feb. 22, 1985

[30] Foreign Application Priority Data

Feb. 27, 1984 [DE] Fed. Rep. of Germany ..... 3407088

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,532,391 7/1985 Bernt ..... 200/144 B

FOREIGN PATENT DOCUMENTS 3227482 2/1983 Fed. Rep. of Germany .

*Primary Examiner*—Robert S. Macon

*Attorney, Agent, or Firm*—Kenyon & Kenyon

[57] ABSTRACT

A contact arrangement comprising two cup-type contacts having hollow-cylindrical contact carriers arranged coaxially with each other and having slots inclined in the same sense to the longitudinal axis of the contact arrangement. The slots act as a coil for generating a magnetic field for minimizing arc currents. The condition $$\left(8 + 0.1\,D/\text{mm} + 3\,\frac{D/\text{mm}}{s}\right)^{\circ} \leqq B \leqq (150 + 0.5\,D/\text{mm})^{\circ}$$

is met in a range of the outside diameter D of the contact carriers of from 60 to 150 mm, a predetermined height $H_T$ of the contact carriers, a number s of the slots and an azimuth B of the slots. With this design, a contact arrangement with an axial magnetic field of at least 3.5 uT/A is obtained.

4 Claims, 6 Drawing Figures

CONTACT ARRANGEMENT FOR VACUUM SWITCHES

BACKGROUND OF THE INVENTION

The present invention relates to a contact arrangement for vacuum switches having cup-type contacts which are arranged coaxially opposite each other, are movable relative to each other in the axial direction and each of which have hollow-cylindrical contact supports which contain slots inclined to the longitudinal axis in the same sense, the contact supports each supporting a contact plate for providing electrical contact.

As is well known, the maximum breaking capacity of vacuum switches is given by the maximum values of the current which can be switched off safely and the returning voltage after the arc is broken, and can be influenced favorably by a magnetic field which is directed parallel to the direction of the arc current. A contraction of the arc which leads to an increase of the arc voltage and the power conversion connected with this voltage can be prevented by a coaxial magnetic field in the vicinity of the arc between the open contacts. For this purpose, a coil cylindrically enclosing the switching chamber can be provided with these so-called axial field contacts. The coil is connected in series electrically with the switch contacts and builds up an axial magnetic field which depends on the current and which permeates the gap between the coaxial contacts in the axial direction. For increasing the field strength in the contact gap, the coil can also be constructed with two layers and the turns can be made to run back and forth in the manner of a helix. The manufacture of such vacuum switches, however, is relatively expensive.

In one known embodiment of a contact arrangement for vacuum switches with cup-type contacts which are arranged coaxially and opposite each other and are movable in their axial direction relative to each other, the axial magnetic field between the open contacts is generated by coil turns which are made by slots in the two contact carriers. These slots have the same direction of rotation in both contacts. The end faces of the contact carriers facing each other are each covered by the rim of a substantially disk-shaped contact surface or plate. Between the contact plate and the bottom of the contact, a support body of mechanically strong and electrically poorly conducting material can further be provided. The contact plates are generally provided with radial slots for suppressing eddy currents. See, e.g., DE-OS No. 32 27 482.

SUMMARY OF THE INVENTION

It is an object of the present invention to provide a contact arrangement of the type mentioned above such that a large current-carrying capacity is assured and so that the temperature rise due to the nominal current remains low. At the same time, a homogeneous magnetic field sufficient for extinguishing large short circuit currents is to be generated at the same time in the arcing phase in the gap between the open contacts. For this purpose, a sufficiently effective number of turns is required; at the same time, however, the resistance of the segments, formed between the slots of the contact carrier acting as a coil must be limited accordingly. In addition, it should further be possible to manufacture the contact in a still simpler manner. The invention is based on the insight that the generation of the required magnetic field is possible only within certain ranges of different relationships of the influence factors determining the magnetic field relative to each other. Also, with a larger contact diameter, a magnetic field sufficiently large and homogeneous must be ensured so that a diffused arc is obtained and, at the same time, the arc voltage is maintained as low as possible.

The above and other objects of the present invention are achieved by a contact arrangement for a vacuum switch comprising a pair of cup-type contacts, each contact comprising a hollow, cylindrical contact carrier for supporting a contact plate having a cup depth $H_T$, the contacts being arranged coaxially opposite each other and being movable in their axial direction relative to each other, the contact carriers each having a plurality of slots inclined in the same sense with respect to a longitudinal axis of the arrangement, the contact carriers having an outside diameter D, a range for the outside diameter D being 60 mm$\leqq$D$\leqq$150 mm, and wherein the cup depth $H_T$, the number of slots s and the azimuth B of the slots are determined by the following conditions:

$$0.1\,D \leqq H_T \leqq 0.5\,D \qquad \text{(a)}$$

$$0.03\,D/\text{mm} \leqq s \leqq 0.1\,D/\text{mm}$$

$$\left(8 + 0.1\,D/\text{mm} + 3\,\frac{D/\text{mm}}{s}\right)^{\circ} \leqq B \leqq (150 + 0.5\,D/\text{mm})^{\circ} \qquad \text{(c)}$$

With this contact design, a specific magnetic induction $B_z/I$ of at least 3.5 uT/A, and preferably at least 4 uT/A is obtained in the air gap between the open contacts. Further particularly advantageous embodiments will be apparent from the description which follows. While with a predetermined diameter D of the contacts, a cup depth $H_T$>0.1 D is sufficient, it is preferably chosen as 0.15 D and in particular at least 0.2 D. For a relatively large cup depth $H_T$ up to about 0.5 D, a correspondingly small angle of inclination $\alpha$ of the slots relative to the axis of the contact can be chosen. The wall thickness W of the contact carriers preferably is matched to the diameter D and the cup depth $H_T$ in such a manner that the contact carriers act, for an average contact spacing, like a pair of Helmholtz coils. Thereby, a particularly homogeneous axial magnetic field is generated in the middle between the contacts. The wall thickness W of the contact carriers acting as coils preferably is chosen to be at least 7 mm and generally should not substantially exceed 10 mm.

BRIEF DESCRIPTION OF THE DRAWINGS

For a further explanation of the invention, reference is made to the drawings, in which an embodiment of a contact arrangement for a vacuum switch according to the invention is illustrated schematically.

DETAILED DESCRIPTION

Figure 1:
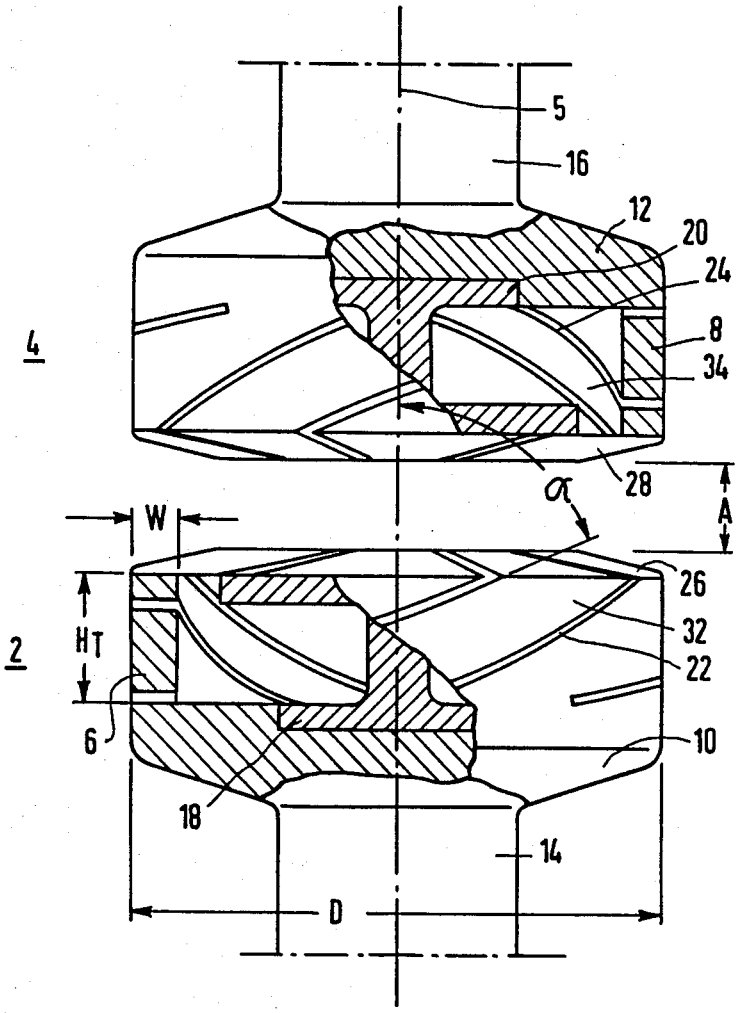
In FIG. 1 contacts are shown in a partially-sectional side view.

With reference now to the drawings, in the embodiment shown in FIG. 1, two contacts 2 and 4 are arranged coaxially opposite each other having their end faces or contact plates at a spacing A of, for instance, 15 mm. Their common axis is indicated-dotted in the figure and is designated with 5. Each contact comprises a hollow-cylindrical contact carrier 6 and 8, respectively, which is coupled via a contact bottom 10 and 12, respectively, to a current lead 14 and 16, respectively, designed as a bolt. The contacts 2 and 4 each contain a support body 18 and 20, respectively, and are each covered by a contact plate 26 or 28, respectively. These contact plates are provided at their rims with bevels, as shown but not specifically designated in FIG. 1, so that they form a central part of the contact-making surface. The support bodies 18 and 20 are designed as bodies of rotation, the ends of which are enlarged so that a cross-section approximately in the form of a double-T beam is obtained.

The contact carriers 6 and 8, the outside diameter D of which may be, for instance, 90 mm, each contain slots 22 and 24 which are inclined at an angle of inclination $\alpha$ relative to the axis 5 of the contact arrangement and which run in the same sense in both contacts 2 and 4, so that the lands 32 and 34 formed between the adjacent slots 22 or 24 are continued in the other contact with the same sense of rotation. The height $H_T$ of the contact carriers, as far as they are provided with slots, forms the respective cup depth, i.e., the entire height $H_T$ of the contact carriers 6 and 8 in the embodiment of the contacts 2 and 4 shown.

The slots 22 and 24 can be designed helically with a constant pitch angle $\alpha$. Such slots can be made with a cylindrical milling cutter, the diameter of which is equal to the slot width and which is at least as long as the wall thickness W of the contact carriers 6 and 8. The slots of the contact carrier 6 and 8, respectively, are arranged helically about axis 5. With a predetermined diameter D and a cup depth $H_T$, the angle of inclination of such helical slots is interlinked with the azimuth B which each of the slots 22 and 24 traverses, by the relationship $$\tan \alpha = (\pi/360°) \cdot B \cdot D/H_T. \quad \text{(I)}$$

Figures 2, 3:
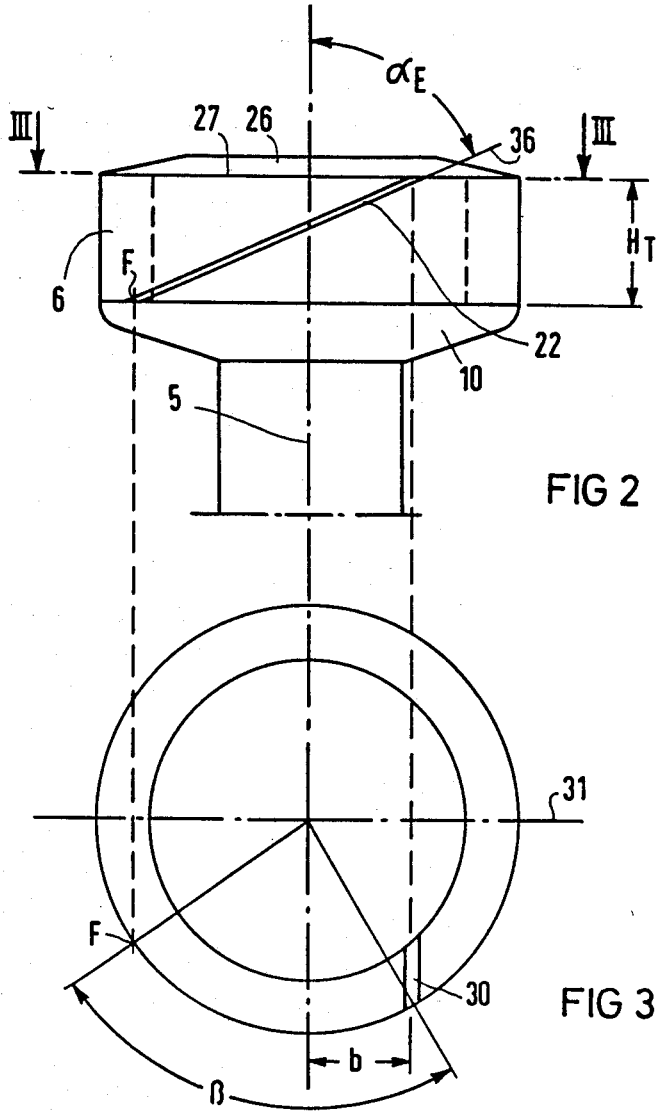
In FIGS. 2 and 3, the design of the slots of the contact carrier is shown as an aid to understanding the invention.

In a particularly simple manner, slots with a plane cutting surface can be made, for instance, by sawing. Such slots, with an angle of inclination $\alpha_E$ relative to the axis 5 and lying in the cross-sectional plane 36 are illustrated in side view in FIG. 2, in which, for simplification, only a single plane section slot 22 is indicated. The angle of inclination $\alpha_E$ of the cross-sectional plane 36 relative to the axis 5 of the contacts 2 and 4 with an azimuth B according to FIG. 3 is obtained from the relationship $$\tan \alpha_E = [b + (D/2) \sin [B - \sin^{-}(2b/D)]]/H_T \quad \text{(II)}$$

where b is the spacing from a line through axis 5 to the straight line 30 of the slot formed by the sectional plane 36 in the bevelled portion of the contact plate 26.

$B - \sin^{-1}(2b/D)$ is preferably chosen as about 90°; it follows therefrom that it meets the condition $$B = 90° + \sin^{-1}(2b/D).$$

Thereby, $\tan \alpha_E$ becomes a maximum if the spacing b, the diameter D and the cup depth $H_T$ are given.

Figure 4:
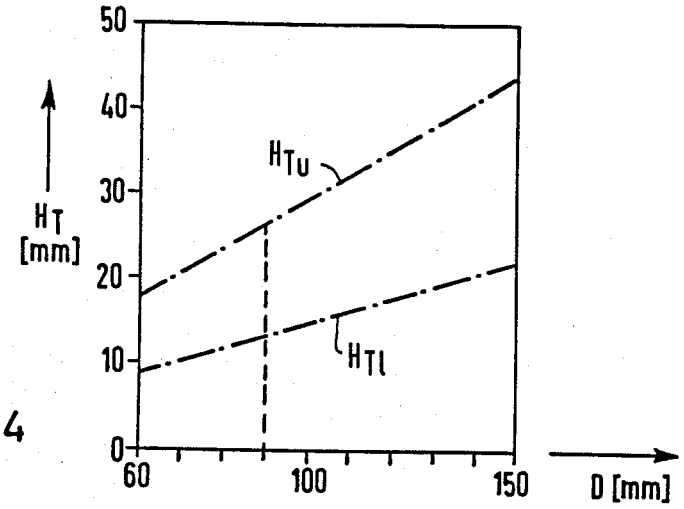
In FIGS. 4 to 6, different limits for the design of the contacts are illustrated, each shown diagrammatically.

In the diagram according to FIG. 4, the cup depth $H_T$ is plotted as a function of the diameter D. For a diameter D of 60 to 150 mm and a lower limit for the cup depth of preferably $H_T = 0.15D$ and an upper limit which preferably does not substantially exceed $H_T = 0.3$ D, the cup depth can be chosen in a range which is given by a lower limit $H_{Tl}$ and an upper limit $H_{Tu}$. For contacts 2 and 4 with a diameter of, for instance, D = 90 mm, as shown by the dashed vertical line, the cup depth $H_T$ can be between about 13.5 and 27 mm, as is indicated in the diagram.

Figure 5:
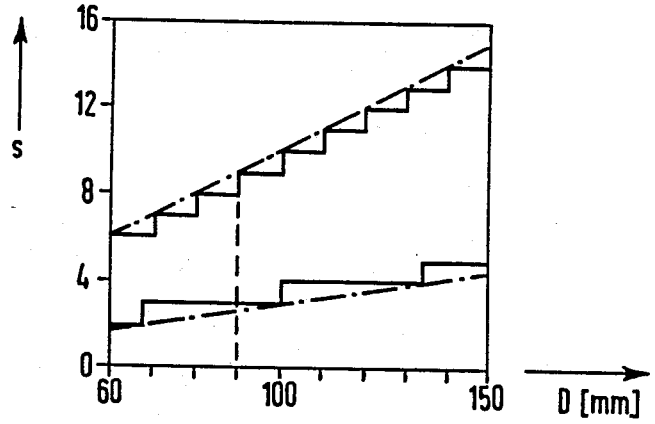

According to the diagram of FIG. 5, in which the number of slots s is plotted as a function of the diameter D, S is chosen in a range, the lower and upper limit of which is fixed in each case approximately by a dashed-dotted straight line. Since only integral numbers are obtained for the number of slots s, a staircase curve is obtained as the lower and upper limit. For a diameter of, for instance, D = 90 mm, as indicated by the dashed line, between 3 and 9 slots can be chosen, as shown in the diagram.

Figure 6:
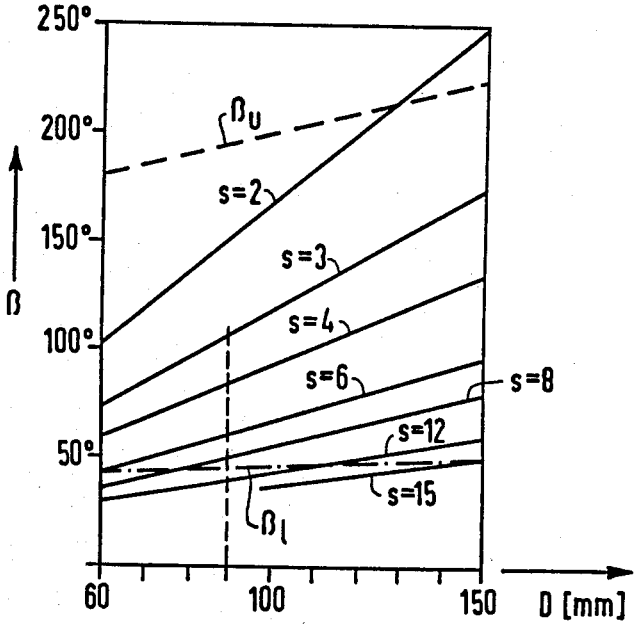

In the diagram according to FIG. 6, the azimuth B of the slots 22 and 24 is plotted as a function of the diameter D. An azimuth B for generating the required specific magnetic inducation $B_Z/I = 3.5$ uT/A in the middle between the two contacts 2 and 4 is plotted by a group of curves. This specific induction is sufficient for generating a diffused arc form also for a large switching current. The parameter of the curves, which in good approximation are straight lines, is the number of slots s in each of the contact carriers 6 and 8. For cup depth $H_T$, the preferably still usable value $H_T = 0.15D$ and a relatively large slot width of, for instance, 2.6 mm were assumed. The dash-dotted limit line $B_l$ corresponding to the relationship $$B = \left(8 + 0.1\, D/\text{mm} + \frac{3\, D/\text{mm}}{s}\right)^{\circ}$$

gives the lower limit of the range for the azimuth B, which makes possible, with suitable values of the number of slots s, the cup depth $H_T$ as well as the slot width, the generation of the required minimum axial field for increasing the switching capacity of the contact arrangement.

The dashed limit line $B_u$ corresponding to the relationship $$B = (150 + 0.5\, D/\text{mm})^{\circ}$$

gives the upper limit of the range for the azimuth B, which makes possible, with suitable values of the number of slots s, the cup depth $H_T$ and a slot width of 2.6 mm, the generation of an axial field required for increasing the switching capacity. For a diameter D = 90 mm, an azimuth B = 108° is obtained for a number of slots s = 3, and for a number of slots s = 8, an azimuth B = 50°, as indicated by the dashed lines in the figure. For plain-cut, preferably sawed slots 22 and 24, one obtains the range to be used for the angle of inclination $\alpha_E$ from equation (II) by substituting for the azimuth B the given range limits. Thereby, the range is obtained:

$$[b + (D/2) \sin [(9 + 0.58\, D/\text{mm})^{\circ} - \sin^{-1}(2b/D)]]/H_T \leqq \tan \alpha_E \leqq [b + (D/2) \sin [(150 + 0.5\, D/\text{mm})^{\circ} - \sin^{-1}(2b/D)]]/H_T \quad \text{(III)}$$

In order, for instance, to obtain in a design of the contacts 2 and 4 with helical slots a specific magnetic induction $B_Z/I = 4.2$ uT/A in the middle between the contacts 2 and 4, the slots must cover, deviating from the diagram of FIG. 6, the azimuth B = 102° and the following specifications are required:

contact diameter: D = 90 mm
cup depth: $H_T = 21$ mm
wall thickness: W = 7.7 mm number of slots per contact carrier: s=6 slot width: $b_s$=1.4 mm contact spacing: A=15 mm

According to equation (I), one obtains for the helical slot profile tan $\alpha$=3.80 and a slot angle $\alpha$=75.3°.

This slot angle $\alpha$ is located approximately in the middle of the range which is determined by the limits 66.2° for the smallest and 82.2° for the largest slot angle.

The resistance for the slotted contact carrier 6 and 8, respectively, which acts as a coil, is obtained as R=2.4 uohms and the resistance of the shunt circuit of one of the contact carriers and the associated support body 18 and 20, respectively, is Rpl=2.15 uohm. Thereby, for a permissible temperature rise generated by the ohmic heat of the contact carriers of 50 K as compared to the beginning of the contact pins 14 and 16, a maximum current carrying capacity $I_{rms/50K}$=7.5 KA is obtained. With the values given for the contact diameter D, the cup depth $H_T$ and the wall thickness W, the contacts 2 and 4, having a mutual spacing $A_H$=13 mm, act as a pair of Helmholtz coils and thereby generate on the axis 5 a homogeneous field between the contacts 2 and 4.

With the contact arrangement according to the invention having a plane slot profile and a diameter D of 90 mm, one obtains a switching capacity corresponding to an interruptable current $I_{rms}$>50 kA with a nominal voltage of 15 kV and an interruptable current $I_{rms}$>31.5 kA for a nominal voltage of 36 kV.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A contact arrangement for a vacuum switch comprising a pair of cup-type contacts, each contact comprising a hollow cylindrical contact carrier for supporting a contact plate having a cup depth $H_T$, the contacts being arranged coaxially opposite each other and being movable in their axial direction relative to each other, the contact carriers each having a plurality of slots inclined in the same sense with respect to a longitudinal axis of the arrangement, the contact carriers having an outside diameter D, a range for the outside diameter D being 60 mm≦D ≦150 mm, and wherein the cup depth $H_T$, the number of slots s and the azimuth B of the slots are determined by the following conditions:

$$0.1\,D \leqq H_T \leqq 0.5\,D \qquad \text{(a)}$$

$$0.03\,D/\text{mm} \leqq s \leqq 0.1\,D/\text{mm}$$

$$\left(8 + 0.1\,D/\text{mm} + 3\,\frac{D/\text{mm}}{s}\right)^{\circ} \leqq B \leqq (150 + 0.5\,D/\text{mm})^{\circ} \qquad \text{(c)}$$

2. The contact arrangement recited in claim 1, wherein 0.15 D≦$H_T$≦0.3 D.

3. The contact arrangement recited in claim 1, wherein the slots have an angle of inclination $\alpha_E$ in a cross-sectional plane with respect to the longitudinal axis and a distance b between a sectional line defining an end of a slot and a line drawn through the longitudinal axis, and wherein the following condition is met:

$$[b + (D/2)\sin[(9 + 0.58\,D/\text{mm})^{\circ} - \sin^{-1}(2b/D)]]/H_T \leqq \tan\alpha_E \leqq [b + (D/2)\sin[(150 + 0.5\,D/\text{mm})^{\circ} - \sin^{-1}(2b/D)]]/H_T.$$

4. The contact arrangement recited in claim 1 wherein the wall thickness W of the contact carrier is 7 mm W≦10 mm.

* * * * *